United States Patent [19]

Glass et al.

[11] 4,297,949

[45] Nov. 3, 1981

[54] CLOUD DETONATOR IN SURFACE-LAUNCHED FUEL-AIR EXPLOSIVE MINEFIELD CLEARANCE ROUND

[75] Inventors: Cecil A. Glass, China Lake, Calif.; Dallas D. Burns, Brooklyn, Minn.

[73] Assignee: The United States of America as represented by the Secretary of the Navy, Washington, D.C.

[21] Appl. No.: 62,395

[22] Filed: Jul. 31, 1979

[51] Int. Cl.[3] ..... F42B 25/12; F42B 15/12

[52] U.S. Cl. ..... 102/229; 102/363; 102/403

[58] Field of Search ..... 102/6, 4, 7.2, 66, 90, 102/223, 229, 254, 278

[56] References Cited

U.S. PATENT DOCUMENTS

| | | | |
|---|---|---|---|
| 3,685,453 | 8/1972 | Hamrick | 102/6 X |
| 3,724,319 | 4/1973 | Zabelka et al. | 102/6 X |
| 3,929,055 | 12/1975 | Lewis | 89/1 M |
| 3,940,443 | 2/1976 | Glass | 102/6 |
| 3,955,509 | 5/1976 | Carlson | 102/90 |
| 3,992,995 | 11/1976 | Wiedermann | 102/6 X |
| 3,999,482 | 12/1976 | Bilek | 102/6 X |
| 4,132,169 | 1/1979 | Gay et al. | 102/6 |
| 4,132,170 | 1/1979 | Hardy et al. | 102/6 |
| 4,141,294 | 2/1979 | Zaharia | 102/6 |

OTHER PUBLICATIONS

SLUFAE: Long-Range Minefield Breaching System Tested, vol. 17, Army Research & Development, May--Jun. 1976, pp. 14 and 15.

*Primary Examiner*—David H. Brown

*Attorney, Agent, or Firm*—R. S. Sciascia; W. Thom Skeer; Kenneth G. Pritchard

[57] ABSTRACT

A detonation system for explosive rounds, such as a fuel air explosive, is made by providing a sealed launch tube detonator assembly arrangement. The cloud detonator provides for a booster charge which is attached to a pyro delay detonator. The pyro delay detonator permits the booster charge to be hurled a discrete distance into the fuel air cloud to insure proper cloud detonator position while at the same time waiting an appropriate time interval to permit complete cloud formation. The detonator assembly is self-sealing in its launch tube to prevent gases, which hurl the detonator assembly out of the launch tube, from burning the fuel air cloud. The cloud detonator assembly itself contains unique safety features which will prevent premature partial burning of booster charge.

20 Claims, 12 Drawing Figures

9A

9B

CLOUD DETONATOR IN SURFACE-LAUNCHED FUEL-AIR EXPLOSIVE MINEFIELD CLEARANCE ROUND

BACKGROUND OF THE INVENTION

1. Field of the Invention

This invention pertains to detonation systems for explosive rounds. In particular it pertains to detonation systems for fuel air explosive rounds where detonation should be delayed upon arrival of the round at the target until proper cloud formation has occured.

2. Description of the Prior Art

The use of fuel air explosives to detonate pressure mines is a known technique. However, previous fuel air delivery systems have been individual round deliveries from aircraft which do not permit systematic clearance of mine fields. Development of a uniquely suited fuel air explosive round for mine field clearance requires that the detonator be self contained in the explosive round and not detonate the fuel air explosive until cloud formation has been completed.

To insure reliability, the detonator should be immersed in the fuel air cloud. Even greater reliability requires that a plurality of detonators, be employed in case of misfire or failure for any reason by either one of them. To improve reliability, the plurality of detonators should be independent from one another, which adds a further requirement that the detonators be separated from the explosive round and one another at the time of their detonation, while still being immersed in the cloud. Any reasonable launch techniques for ejecting these detonators from explosive rounds into the fuel air cloud as it forms will invariably require some form of explosive propelling charge or coiled spring. The use of a charge to jettison detonators from the explosive round runs the risk of producing hot explosive gases which could start burning of the fuel air cloud prior to formation of a shape suitable for cloud detonation. Previous detonators are not capable of satisfying these requirements.

Lastly, the prior art detonation systems that have been used for other explosive rounds are usually designed for long range weapon systems which are suited to aircraft or other standoff delivery systems. These types of systems permit careful handling of the arming system in a manner rarely possible on a battle field. Detonation systems of this nature are in fact not armed until the aircraft has launched the missile. The nature of a mine field clearance round requires a system which is capable of launching multiple rounds at a rapid rate and is adapted to rapid reload and fire capabilities for fluid battle field conditions. Thus, any detonator used in such a round must have stringent ground safety requirements to protect against premature detonation in case of dropping, jiggling or other mishandling of an individual round.

SUMMARY OF THE INVENTION

The present invention provides for launching of two cloud detonators for an explosive round to provide a delayed detonation of that explosive round. A detonator mounting within the explosive round contains two separate launch tubes, each containing a cloud detonator assembly. The detonator assemblies are launched upon the occurence of predetermined conditions. The detonation of an explosive propelling charge provides the momentum to each of the detonator assemblies for them to be launched from the launch tubes. The detonator assemblies each contain a detachable base referred to as an obturator because it is designed to wedge in the launch tube and seal off the explosive gases produced by the explosive propellant charge. If these gases escape into the outside air, they can trigger premature burning of the fuel air explosive. Within the cloud detonator assembly a pyro delay detonator charge burns at a predetermined rate. The pyro delay detonator is ignited by a firing pin impelled into it by the explosion of the explosive propelling charge. Holding the firing pin in place is a shear pin which is severed under the explosion of the explosive propelling charge. The detonator assembly is held in the launch position within the launch tube by the use of a shear wire which is also severed upon the explosion of this charge. The pyro delay detonator is used to detonate a booster charge which detonates the fuel air cloud.

To contain the delay detonator in case it should be prematurely ignited by the firing pin, a slider assembly separates the delay detonator from the booster charge. An aperture within the slider assembly must be aligned with the booster charge and the delay detonator to detonate the booster charge. The slider assembly is locked in an unaligned position by a safety rod while the detonator assembly is within the launch tube. The safety rod is a permanent fixture of the obturator such that, when the obturator is left in the launch tube, the safety rod is removed permitting the slider assembly to move into position. The firing pin is also used to compress a spring via an actuator rod. The spring is pressed against a plunger which is designed to press against the slider assembly. When the slider assembly is free to move, the spring via the plunger will move the slider assembly into position with the delay detonator. To support the booster charge, an apertured bearing plate is placed above the slider assembly. Only when the aperture for both the slider assembly and the bearing plate are aligned with the delay detonator can the delay detonator trigger the booster charge. The bearing plate contains a stop which keeps the slider assembly from going past the alignment position.

A safety feature on the booster charge is a metallic shield such as a thin aluminum film placed on the end of the booster charge facing the delay detonator. The metallic shield supported by an O-ring prevents hot gases present during misfire of the delay detonator from reaching the booster charge. The booster charge could be singed by such gases if the shield and O-ring where not present. The booster charge itself is rigidly fixed within the detonator assembly by means of a booster disc and retaining ring.

DESCRIPTION OF THE PREFERRED EMBODIMENT

Figure 1:
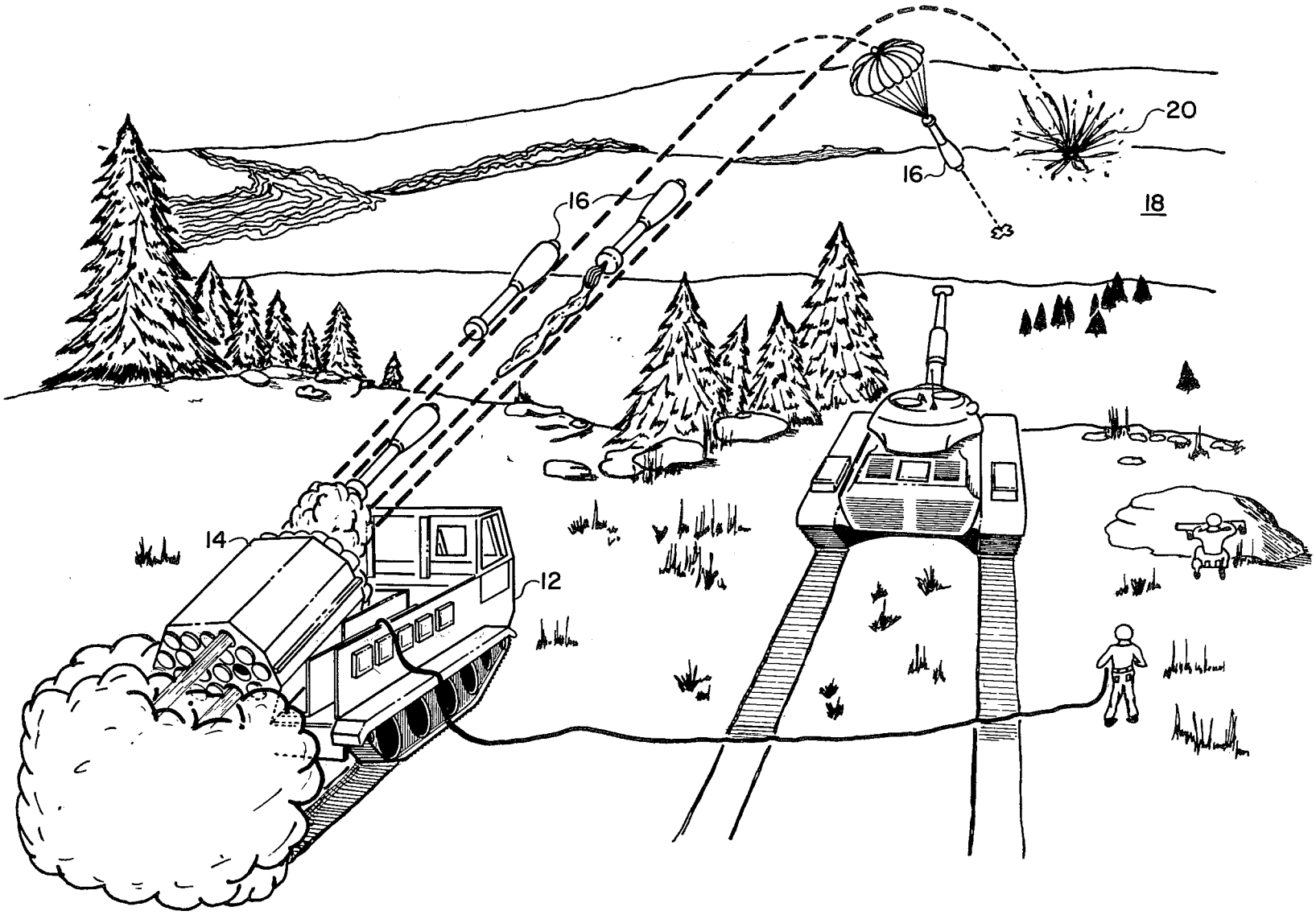
FIG. 1 is an operational view of an explosive round containing the present invention.

FIG. 1 is an operational view of the type of explosive round system which the present invention is designed to help operate. A carrier vehicle 12 is used to transport a launcher 14 which contains explosive rounds 16. Explosive rounds 16, for purposes for example, will be assumed to be mine field clearance rounds based on the use of fuel air explosive such as propylene oxide. As can be seen, a plurality of explosive rounds 16 are fired in a manner designed to land them in staggered position on a minefield 18. Each round sets off a fuel air explosive cloud 20 which clears mines under and near the surface area covered by the fuel air cloud. The staggering of rounds to shorter and shorter landing points as shown, clears a linear path through such a mine field.

Figure 2:
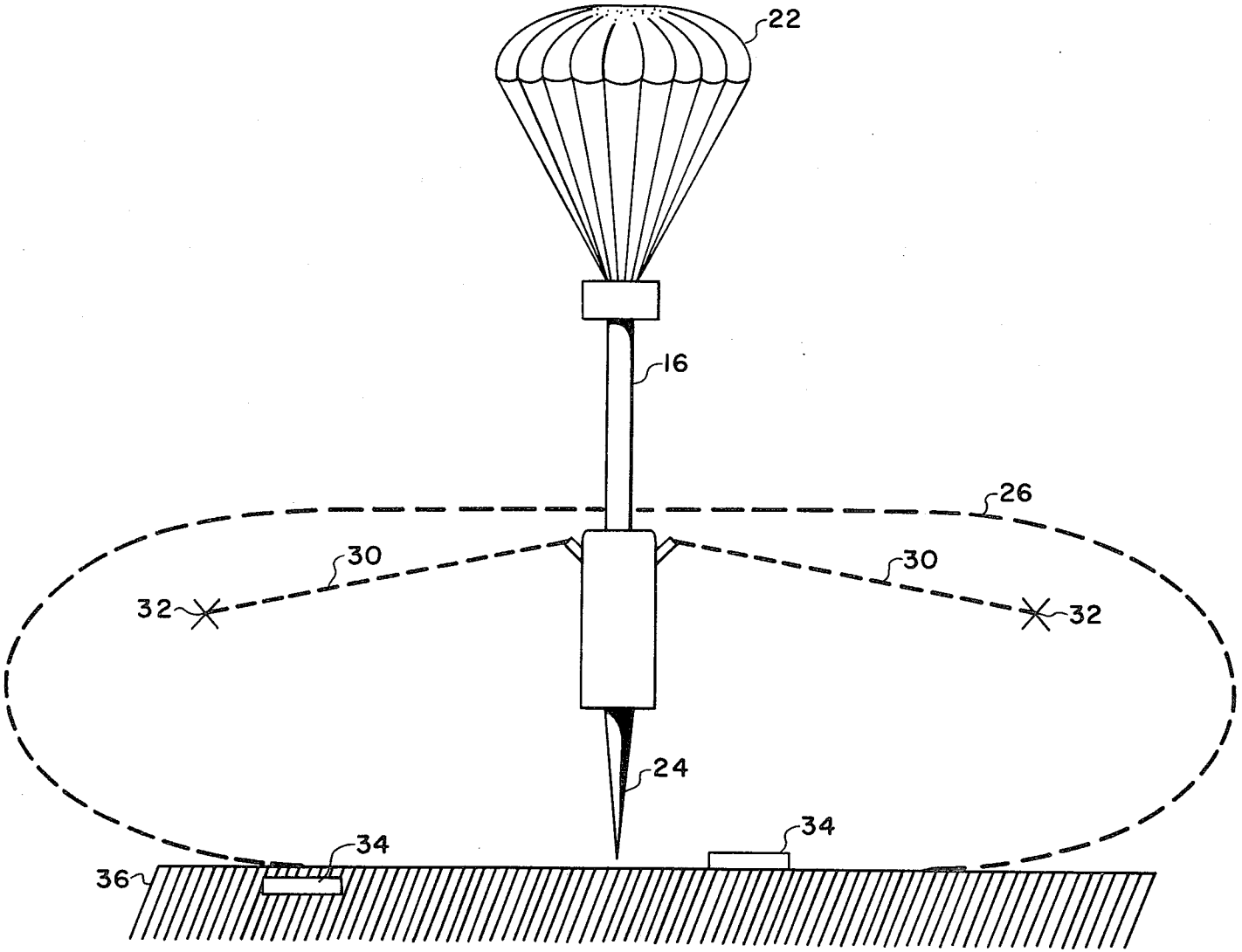
FIG. 2 is a cross section of a fuel air explosive round at the time the detonators in the present invention are in position to go off.

In FIG. 2, the cross section of the fuel air explosive cloud desired after impact of an explosive round 16 is shown. Round 16 is lowered to the ground via a parachute 22 which permits explosive round 16 to land in a predetermined orientation such that a fuze probe 24 can be used to trigger the desired sequence of events at a predetermined height above the ground 36. When probe 24 touches ground 36, the detonation system will eject the cloud detonators through launch ports, not shown, along predetermined paths 30 to detonation points 32. While the detonators are traveling along paths 30, the explosive round itself will be forming a fuel air cloud 26, as shown by the dotted line, over a predetermined surface area of ground 36. Pressure sensitive mines 34 which can be placed either on or beneath the surface of ground 36 are detonated.

Figure 3:
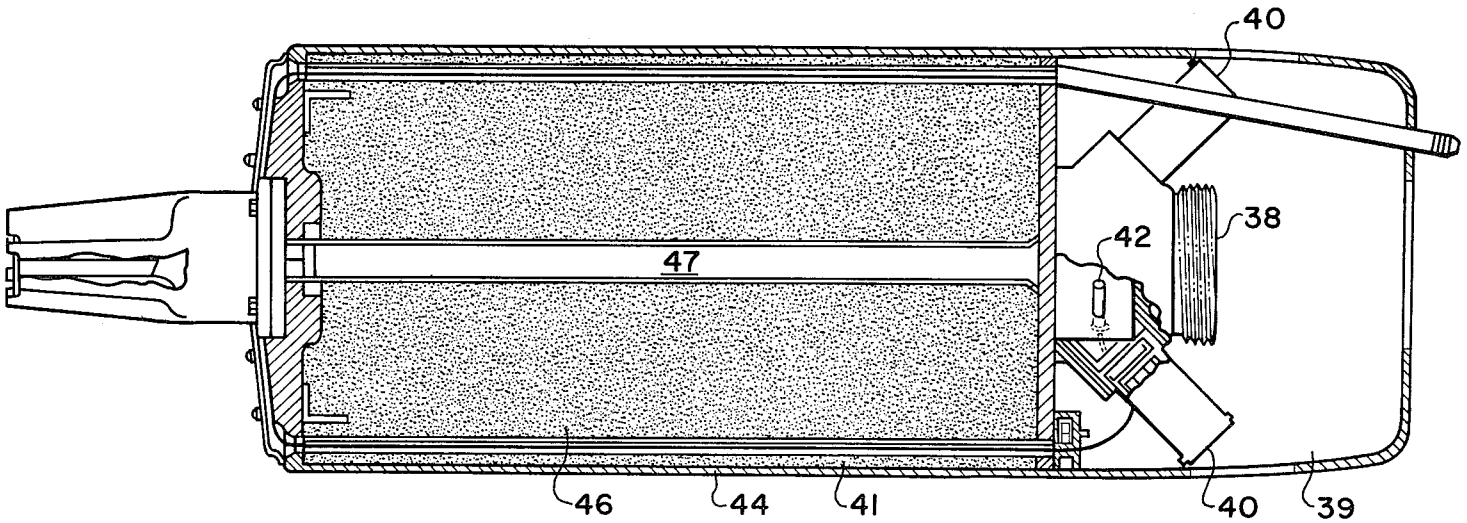
FIG. 3 is a cross section of an example of an explosive round in which the present invention can be used.

FIG. 3 is a cross section of an explosive round which can be used with the present invention. The explosive round will include a casing 44 which contains fuel 46 for a fuel air explosive, such as propylene oxide. The explosive round is divided into two sections 39 and 41. Section 41 contains fuel 46 and the appropriate dispersing means 47 to form the fuel air cloud. The other section 39 contains the cloud detonator chamber 38 which is a mounting that can be cast metal or any other suitable material which holds two launch tubes 40 and an explosive propelling charge 42 shown through the cut away portion of cloud detonator chamber 38. Explosive propelling charge 42, which can be one gram of PPXN-5, is connected to the fuzing system of the explosive round which is not shown. When probe 24, shown in FIG. 2, contacts ground 36, explosive propelling charge 42 detonates. This ejects a detonator assembly from each launch tube 40.

Figure 4:
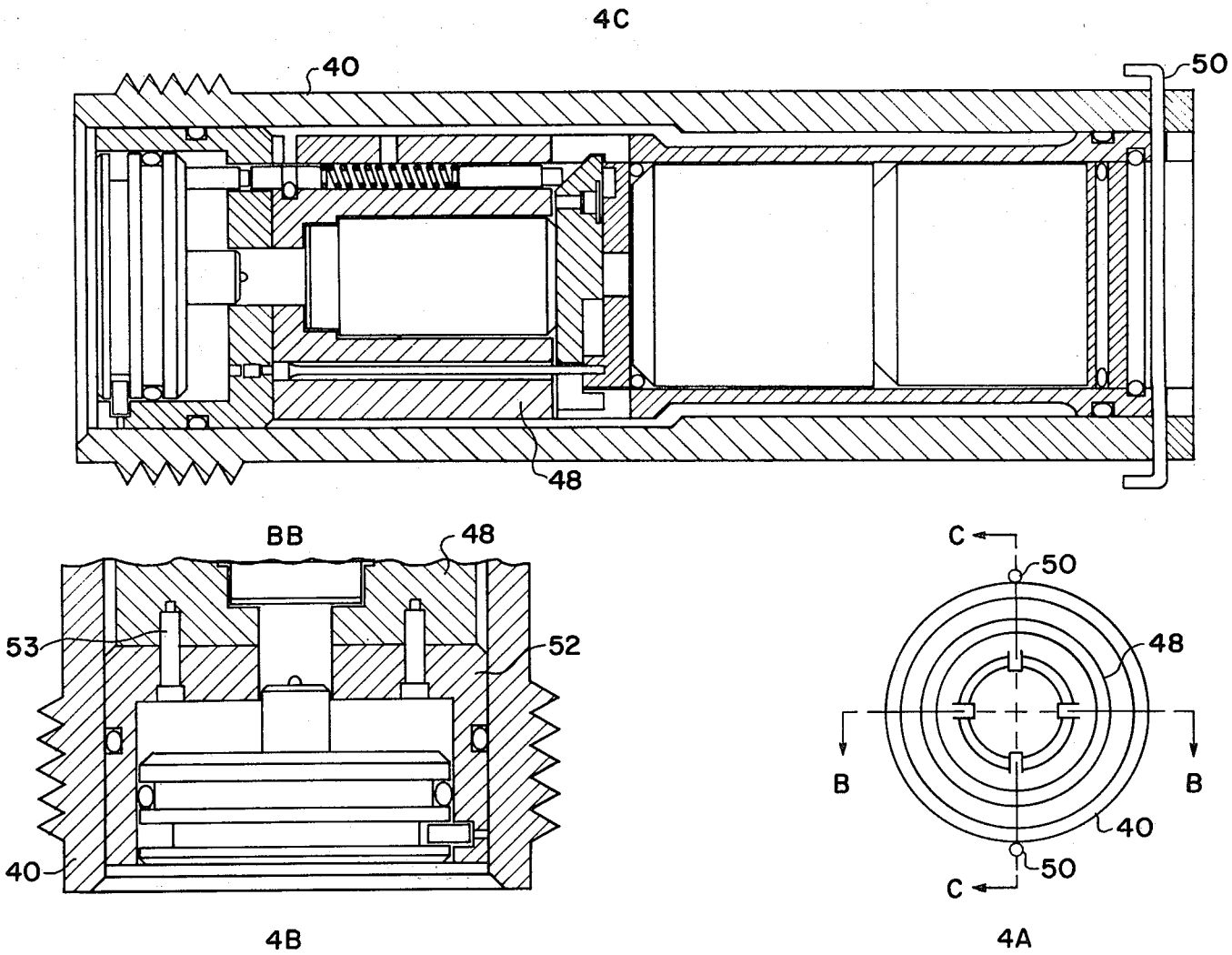
FIGS. 4A, 4B, and 4C are end and cross sectional views of the present invention.

FIG. 4 shows a detailed cross section of launch tube 40 and the detonator assembly 48 which is held in place within launch tube 40 by a shear wire 50. FIG. 4*a* shows an end view of launch tube 40 and detonator assembly 48. A cross section along line BB for the bottom of launch tube 40 and detonator assembly 48 is shown in FIG. 4*b*. A cross section along line CC is shown in FIG. 4*c*. Detonator assembly 48 includes an obturator 52 which is held in place by means of screws 53. Screws 53 only appear for a cross section view in a given plane, as shown in FIG. 4*b*.

Figure 5:
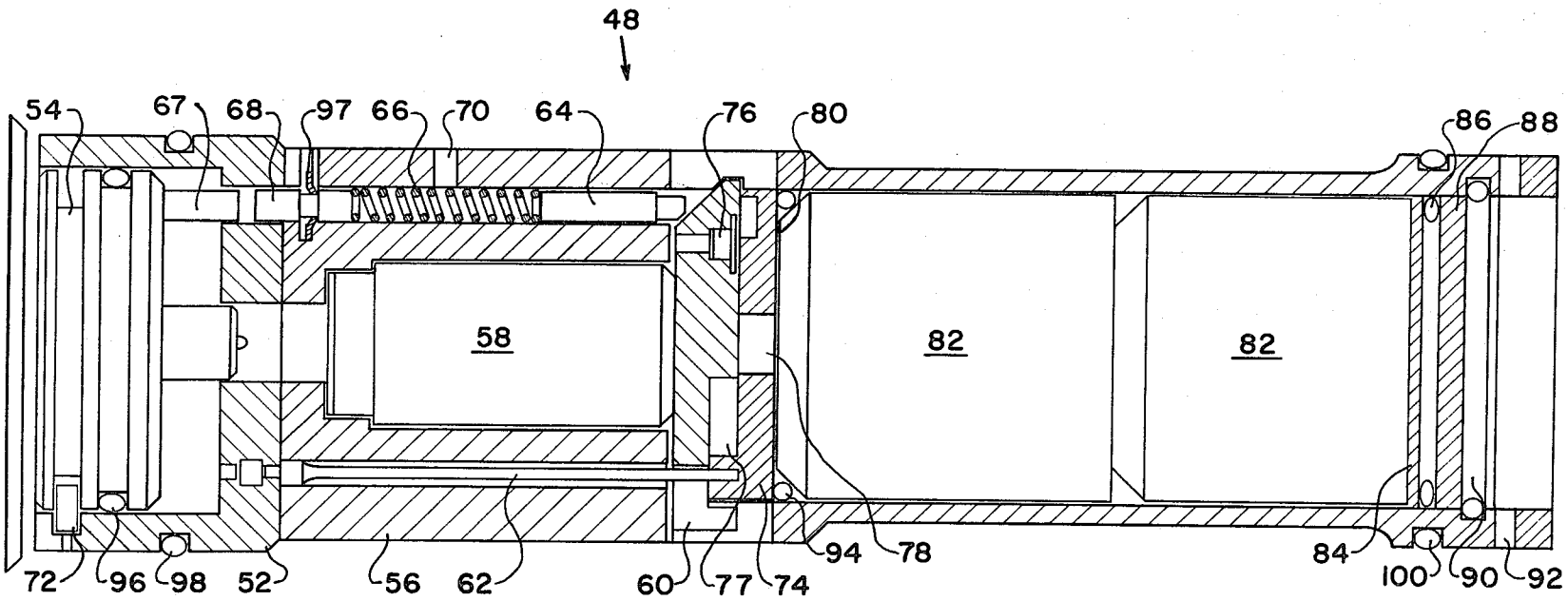
FIG. 5 is a cross section of the detonator assembly of the present invention.

FIG. 5 shows cloud detonator assembly 48 in a sectional view similar to that shown in FIG. 4*c*. Obturator 52 is shown containing a firing pin 54 which has room to move forward within obturator 52. Firing pin 54, when propelled forward, is driven into a delay detonator 58 which is contained within the body 56 of detonator assembly 48. Body 56 may be made of plastic or any other suitable material. Delay detonator 58, which can be a pyro delay detonator, at its far end is against a slider assembly 60 which is shown blocking off delay detonator 58 from booster charges 82. Slider assembly 60 is held in place by a safety rod 62 which is permanently attached to obturator 52. When obturator 52 is separated from the rest of cloud detonator assembly 48, safety rod 62 is withdrawn from slider assembly 60 permitting it to slide into the aligned position. Slider assembly 60 is aligned by a plunger 64 which is in turn moved forward by a compression spring 66. Compression spring 66 is compressed by an actuator rod 68 when firing pin 54 is impelled forward. Firing pin 54 has a pedestal 67 which advances actuator rod 68. A view port 70 is provided to permit visual checking to see if compression spring 66 is in fact in place prior to insertion of cloud detonator assembly 48 into launch tube 40.

Firing pin 54 contains a safety feature to prevent it from being accidentally impelled forward. A shear pin 72 fits into a groove in firing pin 54 and fits within a groove in obturator 52. Shear pin 72 is designed to be severed under a predetermined force which permits a significant safety margin to prevent firing pin 54 from accidently being impelled forward and triggering delay detonator 58.

On the far side of slider assembly 60 is a bearing plate 74 which contains a stop 77 and an aperture 78. Bearing plate 74 is made of any suitable metal to resist structural loading of cloud detonator assembly 48 during launch. Slider assembly 60 contains an aperture 76 filled with explosive. Apperture 76 becomes aligned with aperture 78 of bearing plate 74 upon removal of safety rod 62 and slider assembly 60 is pushed against stop 77. In this configuration, detonation of delay detonator 58 in turn triggers the explosive in aperture 76 which detonates booster pellet charges 82. An additional safety feature is the use of a shield 80 over the end of booster charge 82 against bearing plate 74. Shield 80 can be metallic, such as aluminum foil. Shield 80 can consist of aluminum tape approximately 0.003 of an inch thick. This aluminum tape provides an additional shielding to prevent stray combustion products from a premature detonation of delay detonator 58 from reaching booster charges 82.

Booster charges 82 are shown as two separate pellets in FIG. 5. Uniform density is more easily achieved by compressing pellets in a preset depth to diameter ratio. Therefor, greater reliability is achieved by stacking pellets that are made with a reliable density, rather than merely pressing a booster charge to fit the space available. As can be seen, both pellets have slight tapering at one end. The tapering permits installation of O-ring 94. Holding the booster pellets snugly in position is a booster disc 84, which in turn is supported by packing material 86, which in turn is held in place by a support disc 88, which is anchored in place by a retaining ring 90. This configuration provides the compression necessary to provide a holding means which will maintain all cloud detonation parts in proper position. Above retaining ring 90 is a hole 92 for shear wire 50, shown previously. An O-ring 96 is placed in a separate groove around firing pin 54 to provide predictable uniform sliding action.

A further refinement of detonator assembly 48 is provided by having actuator rod 68 pass through a friction stop 97, a perforated metallic disc, which will permit actuator rod 68 to slide through it under the force of firing pin 54, but will prevent actuator rod 68 from sliding back after it has advanced. This maintains the compression of compression spring 66. Friction stop 97 thus holds actuator rod 68 against compression spring 66 and forces compression spring 66 to relieve its tension via plunger 64 against slider assembly 60.

External to detonator assembly 48 are O-rings 98 and 100 which form a seal between cloud detonator assembly 48 and launch tube 40 as shown in FIG. 5.

Figure 6:
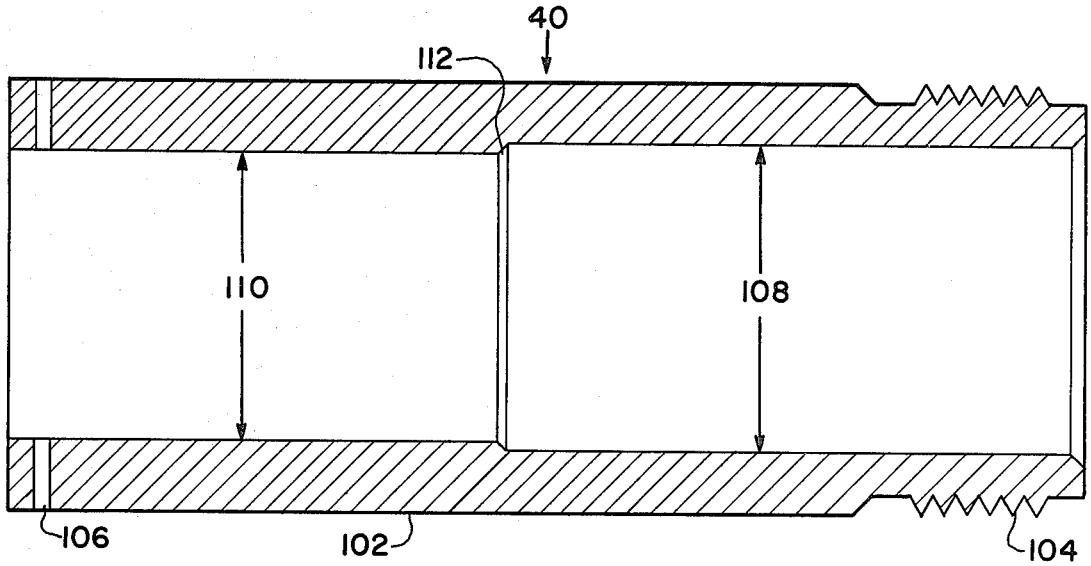
FIG. 6 is a cross section of the launch tube of the present invention.

Launch tube 40 is shown in cut away version in FIG. 6. Launch tube 40 has a wall 102 which is threaded at one end with threads 104 such that launch tube 40 can be screwably inserted into cloud detonator chamber 38 shown previously in FIG. 3. Wall 102 can be made of any suitable metal or composition material capable of withstanding the force of detonator assembly 48 when it travels up launch tube 40 and impacts against tapered surface 112. If wall 102 is too weak, it will not prevent shearing off of launch tube 40 when obturator 52 impacts tapered surface 112. Wall 102 has a shear wire hole 106 for retaining detonator assembly 48 in proper position in launch tube 40. Launch tube 40 has two different interior diameters 108 and 110 with the latter being the small inside diameter and the former being the large inside diameter. Detonator assembly 48 as it accelerates through launch tube 40 due to explosive propelling charge 42 will reach a terminal velocity of approximately 100 feet per second within the distance of the large diameter 108 of wall 102.

Figure 7:
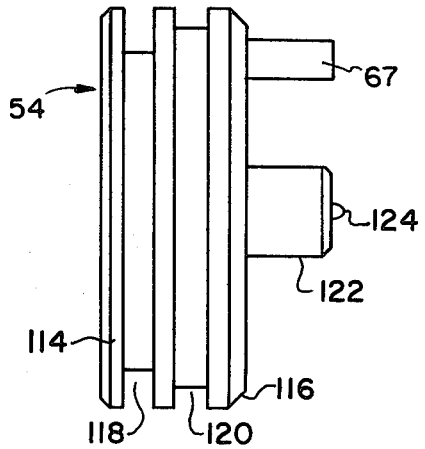
FIG. 7 is a cross section of a firing pin designed for use in the present invention.

Firing pin 54 is shown in further detail in FIG. 7. Firing pin 54 consists of a metallic plug 114 with a leading tapered surface 116. Tapered surface 116 avoids any digging or gauging of firing pin 54 into detachable base 52 which would hinder proper operation of the detonator assembly. Within plug 114, a shear pin groove 118 and an O-ring groove 120 are placed as shown. On the advancing surface of firing pin 54 is a pedestal 122 which ends in a nub 124. Nub 124 is the surface of firing pin 54 impelled into delay detonator 58 causing ignition of delay detonator 58. Pedestal 67 is aligned with actuator rod 68 as described previously.

Figure 8:
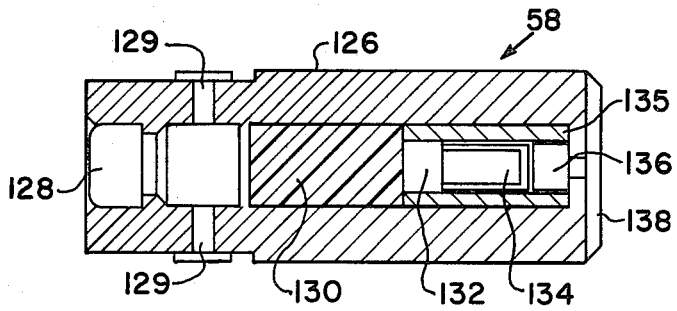
FIG. 8 is a cross section of a pyro delay detonator that can be used in the present invention.

Delay detonator 58 is shown in cross section detail in FIG. 8. Delay detonator 58 consists of housing 126 which can be any suitable material to contain a burning charge. Nub 124 strikes primer 128 which ignites a pyro delay mixture 130. Excess pressure is released via vents 129. Delay mixture 130 burns at a uniform rate for a predetermined time, advancing the length of housing 126 as shown. Primer charge 132, is detonated which in turn detonates output charge 134. A sleeve 135 holds primer charge 132 and output charge 134 in position. A space 136 provides room for the length of pyro delay mixture 130 to be varied. A tape 138 is placed across the end of housing 126 to serve as an environmental barrier.

Figure 9:
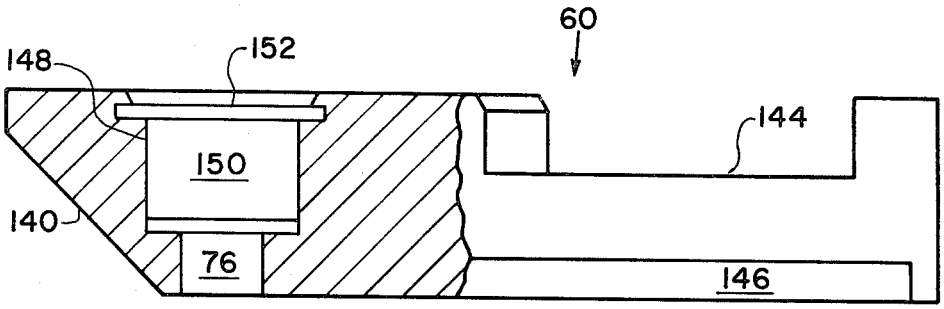
FIG. 9A is a cross section of a slider assembly designed for use in the present invention.
FIG. 9B is a top view of the slider assembly.
Figure 9:
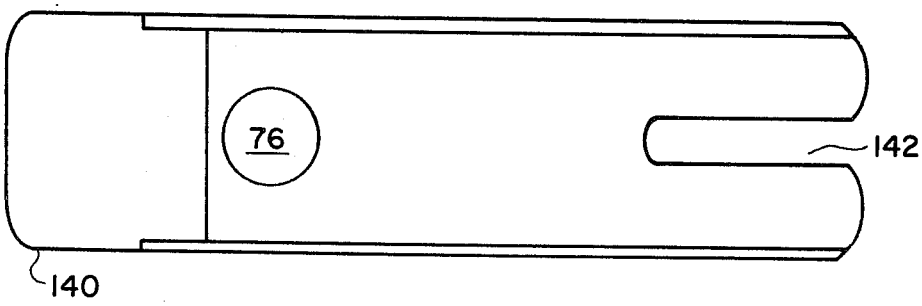

Two views of slider assembly 60 are shown in FIGS. 9*a* and 9*b*. FIG. 9*b* shows the bottom of slider assembly 60 which contains aperture 76 and safety rod notch 142. In addition, slider assembly 60 has a beveled surface 140 to facilitate motion when pressed by plunger 64 as described earlier. Plunger 64 also has a beveled surface which fits against beveled surface 140. Aperture 76 contains a cup 148, shown in cutaway of FIG. 9*a*. Cup 148 contains an explosive 150, such as PPXN-5, which is covered by a lid 152, such as aluminum foil.

(1) Explosive propelling charge 42 is set off upon probe 24 touching ground. The fuel-air cloud is being formed at the same time;

(2) Charge 42 drives firing pin 54 forward with enough force to sever shear pin 72;

(3) Pedestal 67 compresses spring 66 via actuator rod 68. Spring 66 is kept compressed by friction stop 97;

(4) Nub 124 causes ignition of delay detonator 58;

(5) Obturator 52 impacts tapered surface 112 with sufficient momentum to separate obturator 52 from body 56 with safety rod 62 staying with obturator 52;

(6) Compressed spring 66 slides slider assembly 60 via plunger 64 to align aperture 76 with aperture 78;

(7) Delay detonator 58 burns its entire length and ignites the explosive in aperture 76;

(8) The explosive in aperture 76 punctures shield 80 and detonates pellets 82; and (9) Pellets 82 detonate the fuel-air cloud which has body 56 immersed in it.

Numberous modifications of the above disclosure are obvious to those skilled in the art.

We claim:

1. A fuel-air cloud explosive round detonation system that launches a detonator for the explosive round comprising;

a mounting for supporting said detonation system;

a launch tube with two segments of different interior diameter inserted in said mounting for aiming said detonator along a predetermined trajectory;

a cloud detonator assembly with an obturator base within said launch tube, said detonator assembly's obturator having an outside diameter which fits within the larger inside diameter of said launch tube but is larger than the smaller interior diameter of said launch tube for placing a time delayed detonation charge in a preset location of said fuel-air cloud; and an explosive propelling charge placed in said mounting beneath the base of said cloud detonator assembly for launching said cloud detonator assembly;

whereby said obturator remains in said launch tube when it reaches said smaller interior diameter such that explosive gases from said explosive propelling charge are sealed from the outside atmosphere.

2. A detonation system for a fuel-air cloud explosive round as described in claim 1 wherein said cloud detonator assembly comprises:

a firing pin movably mounted in said obturator for triggering a predetermined sequence upon initiation of said explosive propelling charge, said explosive propelling charge driving said firing pin forward;

a delay detonator placed in alignment with said firing pin for causing a preset time delay between initiation of said explosive propelling charge and the detonation of said explosive round when said firing pin is impelled into said delay detonator by said explosive propelling charge;

a booster charge placed at the end of said delay detonator opposite from said firing pin for detonating said explosive round, said booster charge detonated by said delay detonator after passage of the above preset time; and means for holding said booster charge in position near said delay detonator for maintaining high reliability of booster ignition from said delay detonator.

3. A detonation system for a fuel-air cloud explosive round as described in claim 2 further comprising means for preventing premature detonation of said booster charge if said delay detonator ignites prematurely.

4. A detonation system for a fuel-air cloud explosive round as described in claim 3 wherein said premature detonation means comprises:

a slider assembly with an aperture, said slider assembly placed between said booster charge and said delay detonator for preventing detonation of said booster charge unless said slider assembly aperture is aligned with said delay detonator;

a plunger positioned against said apertured slider assembly for moving said slider assembly aperture into alignment with said delay detonator at a predetermined time;

a compression spring connected to said plunger for forcing said plunger against said apertured slider assembly to cause said alignment with said delay detonator;

an actuator rod positioned between said compression spring and said firing pin for compressing said compression spring when said firing pin is driven forward by said explosive propelling charge;

a safety rod permanently attached to said obturator for holding said slider assembly aperture in a nonaligned position with respect to said delay detonator until said obturator has separated from said detonator assembly; and an apertured bearing plate placed between said booster charge and said slider assembly for supporting said booster charge.

5. A detonation system for a fuel-air cloud explosive round as described in claim 4 wherein said actuator rod further comprises means for maintaining said compression spring in the compressed state caused by said actuator rod until said slider assembly is free to be moved by said plunger.

6. A detonation system for a fuel-air cloud explosive round as described in claim 2, claim 3, claim 4, or claim 5 further comprising a shear pin imbedded in both said obturator and said firing pin for preventing movement of said firing pin unless a predetermined force is exerted to sever said shear pin.

7. A detonation system for a fuel-air cloud explosive round as described in claim 2, claim 3, claim 4, or claim 5 further comprising a shield between said booster charge and said delay detonator for resisting detonation of said booster charge unless said shield is punctured by a predetermined force such as the detonation of said delay detonator.

8. A detonation system for a fuel-air cloud explosive round as described in claim 2, claim 3, claim 4 or claim 5 wherein said booster charge is comprised of a plurality of charges in the form of pellets for allowing uniform density in each pellet when made.

9. A detonation system as described in claim 1 wherein said cloud detonator assembly further comprises:

a firing pin mounted in said obturator for triggering a predetermined sequence upon initiation of said explosive propelling charge;

a shear pin imbedded in both said obturator and said firing pin for preventing movement of said firing pin unless a predetermined force is exerted which severs said shear pin;

a delay detonator placed in front of said firing pin for causing a preset time delay between initiation of said explosive propelling charge and the detonation of said explosive round, said delay detonator triggered by said firing pin;

a booster charge placed at the end of said delay detonator opposite from said firing pin for detonating said explosive round, said booster charge detonated by said delay detonator after passage of the above preset time;

a slider assembly with an aperture, said slider assembly placed at the end of said delay detonator opposite from said firing pin for preventing firing of said explosive round unless said slider assembly aperture is aligned with said delay detonator;

an apertured bearing plate placed between said booster charge and said apertured slider assembly for supporting said booster charge;

a plunger positioned against said aperture slider assembly for moving said slider assembly aperture into alignment at a predetermined time;

a compression spring connected to said plunger for forcing said plunger against said apertured slider assembly;

an actuator rod positioned between said compression spring and said firing pin for compressing said compression spring when said firing pin severs said shear pin;

a safety rod permanently attached to said obturator for holding said slider assembly in a nonalignment position until said base is detached;

a shield between said bearing plate and said booster charge for resisting detonation of said booster charge unless said shield is punctured, said shield's thickness providing no hinderance to detonation when said delay detonator, slider assembly aperture and bearing plate aperture are in alignment;

a holding means placed against said booster charge for holding said booster charge in position for detonation; and a shear wire placed through said cloud detonator assembly and said launch tube for holding said detonator assembly in launch position within said launch tube, said shear wire severed upon detonation of said explosive propelling charge.

10. A detonation system for a fuel-air cloud explosive round as described in claim 9 wherein said booster charge is comprised of a plurality of charges in the form of pellets for allowing uniform density in each charge when made.

11. A detonation system for a fuel-air cloud explosive round as described in claim 9 wherein said actuator rod further comprises means for maintaining said compression spring in the compressed state caused by said actuator rod until said apertured slider assembly is free to be moved by said plunger.

12. A detonation system for a fuel-air cloud explosive round as described in either claim 5 or claim 11 wherein said maintenance means comprises a friction stop.

13. A detonation system for a fuel-air cloud explosive round as described in claim 1, 2, 3, 4, 9, 11, or 10 wherein said explosive propelling charge is one gram of PPXN-5.

14. A detonation system for a fuel-air cloud explosive round as described in claim 2, 3, 4, 5, 9, 11 or 10 wherein said delay detonator is a pyro delay detonator.

15. A detonation system for a fuel-air cloud explosive round as described in claim 4, 5, 9, 11 or 10 wherein said apertured slider assembly has said aperture filled with explosive.

16. A detonation system for a fuel-air cloud explosive round as described in claim 4, 5, 9, 11 or 10 wherein said apertured slider assembly has said aperture filled with PPXN-5.

17. A detonation system for a fuel-air cloud explosive round as described in claim 4, 5, 9, 11 or 10 wherein said apertured bearing plate further comprises a stop to hold said slider assembly aperture in aligned position with said bearing plate aperture.

18. A detonation system for a fuel-air cloud explosive round as described in claim 2, claim 3, claim 4, or claim 5 further comprising a shield of aluminum foil between said booster charge and said delay detonator for resisting detonation of said booster charge unless said foil is punctured by a predetermined force such as the detonation of said delay detonator.

19. A detonation system for a fuel-air cloud explosive round as described in claim 4, 5, 9, 11 or 10 further comprising an O-ring between the edge of said bearing plate and said booster charge for preventing hot gases from premature detonation of said delay detonator from singeing said booster charge.

20. A detonation system for a fuel-air cloud explosive round as described in claim 9, claim 11 or claim 10 wherein said holding means comprises:

a booster disc against said booster charge;

packing material against said booster disc for supporting said booster disc against said booster charge;

a support disc against said packing material for maintaining said packing material in place; and a retaining ring against said support disc for anchoring said support disc in a predetermined position.

* * * * *